US008662773B2

(12) United States Patent
Yoshioka

(10) Patent No.: US 8,662,773 B2
(45) Date of Patent: Mar. 4, 2014

(54) ELECTRONIC APPARATUS

(75) Inventor: Yukio Yoshioka, Kawasaki (JP)

(73) Assignee: NEC Infrontia Corporation, Kanagawa (JP)

( * ) Notice: Subject to any disclaimer, the term of this patent is extended or adjusted under 35 U.S.C. 154(b) by 1333 days.

(21) Appl. No.: 12/182,481

(22) Filed: Jul. 30, 2008

(65) Prior Publication Data

US 2009/0031534 A1 Feb. 5, 2009

(30) Foreign Application Priority Data

Jul. 31, 2007 (JP) ..... 2007-199714

(51) Int. Cl.
*B41J 29/02* (2006.01)

(52) U.S. Cl.
USPC ..... 400/693; 400/691; 400/692

(58) Field of Classification Search
USPC ..... 400/691–693; 347/108, 138, 152, 170, 347/172; 16/54, 68, 221–392
See application file for complete search history.

(56) References Cited

U.S. PATENT DOCUMENTS 5,377,396 A * 1/1995 Moran, Jr. ..... 29/11
5,995,373 A * 11/1999 Nagai ..... 361/755
6,494,631 B1 * 12/2002 Mastinick ..... 400/208

FOREIGN PATENT DOCUMENTS

JP 10-268599 A 10/1998
JP 2000-347319 A 12/2000
JP 2001-121764 A 5/2001
JP 2001-310512 A 11/2001
JP 2002-191815 A 7/2002
JP 2003-149754 A 5/2003
JP 2007-83517 A 4/2007

* cited by examiner

*Primary Examiner* — Christopher Stanford
(74) *Attorney, Agent, or Firm* — Sughrue Mion, PLLC

(57) ABSTRACT

In order to cope with a change in design between a printer having a hip down design specification (first specification) and another printer having a hip up design specification (second specification), each of a lower frame and an upper frame has a structure common to both of the specifications. The lower frame and the upper frame are coupled to each other by a hinge structure removably attached to the lower frame and the upper frame. The hinge structure is selected from a first hinge structure and a second hinge structure. By changing the hinge structure from the first hinge structure to the second hinge structure and vice versa, the height of a hinge center can easily be changed.

10 Claims, 5 Drawing Sheets

FIG. 5A
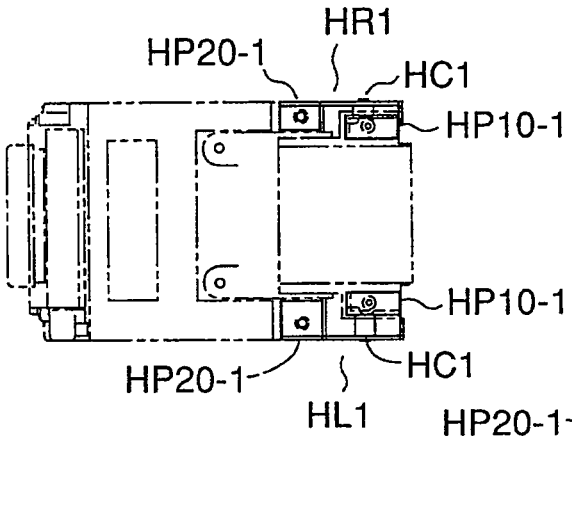
FIG. 5B
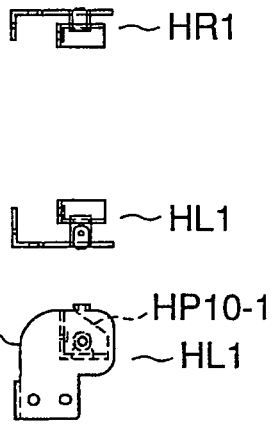
FIG. 5C
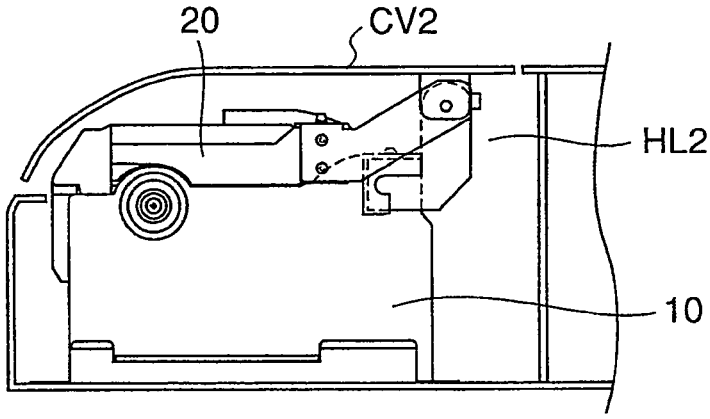
FIG. 6

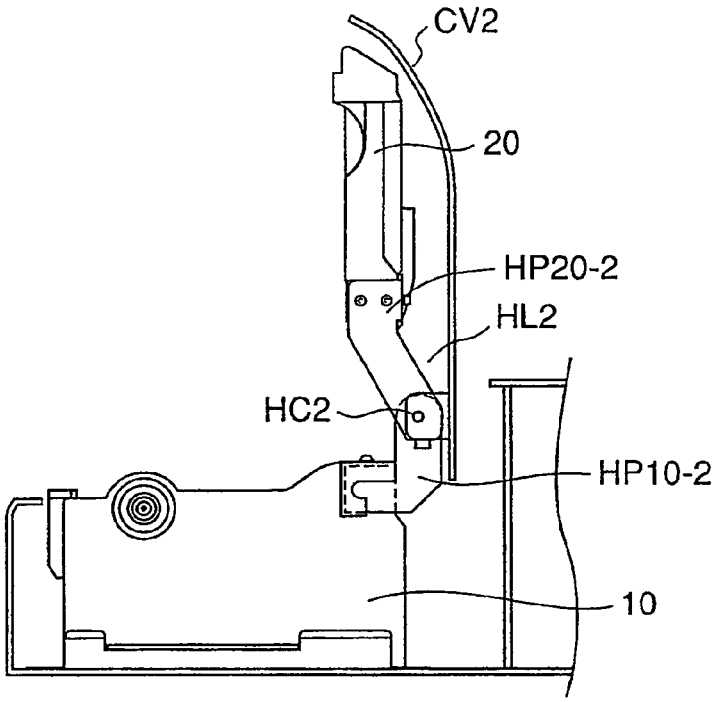
FIG. 7
FIG. 8A
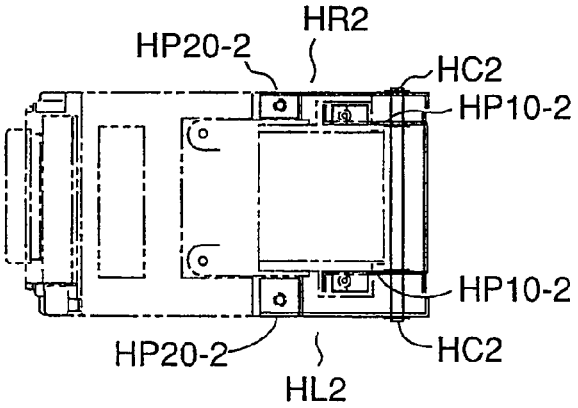
FIG. 8B
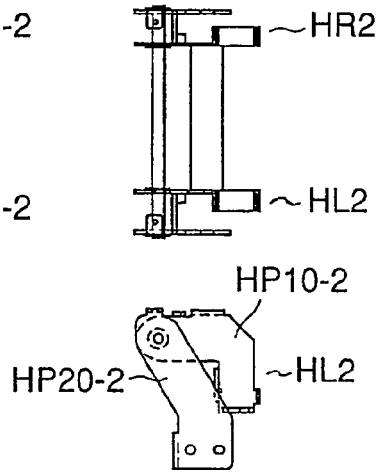
FIG. 8C

ELECTRONIC APPARATUS

This application is based upon and claims the benefit of priority from Japanese patent application No. 2007-199714, filed on Jul. 31, 2007, the disclosure of which is incorporated herein in its entirety by reference.

BACKGROUND OF THE INVENTION

This invention relates to an electronic apparatus and, in particular, to a printer as a specific example of the electronic apparatus.

As an electronic apparatus, description will hereinafter be made of a stand-alone printer (independently operable as a printer) associated with a POS (point-of-sale) terminal and used stand-alone and a built-in printer built in a POS terminal. As will readily be understood, however, this invention is also applicable to any printer for use with various apparatuses other than the POS terminal and to various electronic apparatuses other than the printer.

Each of the stand-alone printer and the built-in printer for a POS terminal is a small-sized printer for performing printing on a roll paper.

A printer of the type has a simple structure and is advantageous in order to achieve a small size, a low cost, and easy maintenance. Therefore, the printer of the type is used, for example, with a POS terminal which issues a receipt.

A receipt printer for performing printing on a receipt paper is disclosed, for example, in JP-A-2001-310512 and JP-A-2001-121764.

The receipt printer comprises a lower frame loaded with a roll paper and an upper frame covering the lower frame and performs printing on a paper surface while the roll paper is fed out. The receipt printer has a hinge structure allowing the upper frame to openably cover the lower frame.

SUMMARY OF THE INVENTION

The receipt printer is classified into a printer having a design specification in which a printer hip portion is lowered (which will hereinafter be called a "hip down design specification" or a "first specification") and another printer having another design specification in which a printer hip portion is raised (which will hereinafter be called a "hip up design specification" or a "second specification").

Typically, the printer of the hip down design specification (first specification) is a stand-alone printer independent of the POS terminal while the printer of the hip up design specification (second specification) is a built-in printer built in the POS terminal.

The printer of the hip down design specification (first specification) and the printer of the hip up design specification (second specification) are different from each other in the hinge structure allowing the upper frame to openably cover the lower frame. That is, the printer of the hip down design specification (first specification) has a hinge structure of the hip down design specification (first specification) while the printer of the hip up design specification (second specification) has a hinge structure of the hip up design specification (second specification). In order to achieve a hip up design of the printer, the hinge structure of the hip up design specification (second specification) has a hinge center higher in level than that of the hinge structure of the hip down design specification (first specification).

As mentioned above, the printer (stand-alone printer) of the hip down design specification (first specification) and the printer (built-in printer) of the hip up design specification (second specification) are different in hinge structure. Therefore, between the former and the latter printers, the lower and the upper frames connected by the hinge structure are different in design and component parts. Accordingly, a printer assembly line and a parts supply schedule are also different therebetween.

It is therefore an object of this invention to provide an electronic apparatus which has a structure common to an electronic apparatus of a first specification and another electronic apparatus of a second specification, which allows a reasonable schedule for assembly and parts supply to be made, and which is excellent in productivity.

Electronic apparatuses according to this invention are as follows:

(1) An electronic apparatus comprising a lower frame, an upper frame, and a hinge structure allowing the upper frame to openably cover the lower frame, wherein:

the hinge structure is removably attached to the lower frame and the upper frame and is selected from a first-specification hinge structure and a second-specification hinge structure;

the first-specification hinge structure comprising:

a first lower frame hinge piece having a first hinge center at its center and removably attached to the lower frame so that the first hinge center is positioned on an upper surface of the lower frame; and a first upper frame hinge piece having the first hinge center at its one end and having the other end removably attached to the upper frame;

the second-specification hinge structure comprising:

a second lower frame hinge piece having a second hinge center at its one end and having the other end removably attached to the lower frame so that the second hinge center is positioned above the upper surface of the lower frame; and a second upper frame hinge piece having the second hinge center at its one end and having the other end removably attached to the upper frame.

(2) The electronic apparatus according to (1), wherein:

the first lower frame hinge piece of the first-specification hinge structure is removably attached to the lower frame so that the first hinge center is positioned on the upper surface of a rear part of the lower frame;

the second lower frame hinge piece of the second-specification hinge structure being removably attached at its other end to the lower frame so that the second hinge center is positioned rearward from the rear part of the lower frame and above the upper surface of the lower frame.

(3) The electronic apparatus according to (2), wherein:

the distance between the one end and the other end of the second upper frame hinge piece of the second-specification hinge structure is greater than the distance between the one end and the other end of the first upper frame hinge piece of the first-specification hinge structure.

(4) The electronic apparatus according to (1), further comprising a cover structure which covers an upper side of the upper frame and which is selected from a first-specification cover structure and a second-specification cover structure;

the first-specification cover structure comprising:

a first-specification cover main body rotatably attached to the first hinge center of the first-specification hinge structure and openably covering the upper side of the upper frame and an upper side of the first-specification hinge structure;

the second-specification cover structure comprising:

a second-specification cover main body rotatably attached to the second hinge center of the second-specification hinge structure and openably covering the upper side of the upper frame and an upper side of the second-specification hinge structure.

(5) The electronic apparatus according to (1), wherein:

the electronic apparatus is a printer which comprises the lower frame loaded with a roll paper and the upper frame covering the lower frame and which performs printing to a paper surface while the roll paper is fed out.

(6) The electronic apparatus according to (1), wherein:

the first specification is a hip down design specification of the electronic apparatus while the second specification is a hip up design specification of the electronic apparatus.

(7) An electronic apparatus comprising a lower frame, an upper frame, and a pair of hinge structure allowing the upper frame to openably cover the lower frame, wherein:

the hinge structures are removably attached to the lower frame and the upper frame and are selected from a pair of first-specification hinge structures and a pair of second-specification hinge structures;

each of the first-specification hinge structures comprising:

a first lower frame hinge piece having a first hinge center at its center and removably attached to the lower frame so that the first hinge center is positioned on an upper surface of the lower frame;

a first upper frame hinge piece having the first hinge center at its one end and having the other end removably attached to the upper frame;

each of the second-specification hinge structures comprising:

a second lower frame hinge piece having a second hinge center at its one end and having the other end removably attached to the lower frame so that the second hinge center is positioned above the upper surface of the lower frame; and a second upper frame hinge piece having the second hinge center at its one end and having the other end removably attached to the upper frame.

(8) The electronic apparatus according to (7), wherein:

the first lower frame hinge piece of each of the first-specification hinge structures is removably attached to the lower frame so that the first hinge center is positioned on the upper surface of a rear part of the lower frame;

the second lower frame hinge piece of each of the second-specification hinge structures is removably attached at its other end to the lower frame so that the second hinge center is positioned rearward from the rear part of the lower frame and above the upper surface of the lower frame.

(9) The electronic apparatus according to (8), wherein:

the distance between the one end and the other end of the second upper frame hinge piece of each of the second-specification hinge structures is greater than the distance between the one end and the other end of the first upper frame hinge piece of each of the first-specification hinge structures.

(10) The electronic apparatus according to (7), further comprising a cover structure which covers an upper side of the upper frame and which is selected from a first-specification cover structure and a second-specification cover structure;

the first-specification cover structure comprising:

a first-specification cover main body rotatably attached to the first hinge centers of the first-specification hinge structures and openably covering the upper side of the upper frame and upper sides of the first-specification hinge structures;

the second-specification cover structure comprising:

a second-specification cover main body rotatably attached to the second hinge centers of the second-specification hinge structures and openably covering the upper side of the upper frame and upper sides of the second-specification hinge structures.

(11) The electronic apparatus according to (7), wherein:

the electronic apparatus is a printer which comprises the lower frame loaded with a roll paper and the upper frame covering the lower frame and which performs printing to a paper surface while the roll paper is fed out.

(12) The electronic apparatus according to (7), wherein:

the first specification is a hip down design specification of the electronic apparatus while the second specification is a hip up design specification of the electronic apparatus.

The electronic apparatus according to this invention has a structure common to an electronic apparatus of a first specification and another electronic apparatus of a second specification, allows a reasonable schedule for assembly and parts supply to be made, and is excellent in productivity.

BRIEF DESCRIPTION OF THE DRAWING

FIGS. 5A, 5B, and 5C are orthographic views (a top view, a side view, and a front view) showing a pair of hinge portions used in the printer in FIG. 3;

FIG. 6 is a view for describing a printer (built-in printer built in a POS terminal) of a hip up design specification (second specification) according to the one embodiment of this invention in a state where an upper frame is closed;

FIG. 7 is a view showing the printer in FIG. 6 in a state where the upper frame is opened; and FIGS. 8A, 8B, and 8C are orthographic views (a top view, a side view, and a front view) showing a pair of hinge portions used in the printer in FIG. 6.

DESCRIPTION OF THE EXEMPLARY EMBODIMENTS

Figure 1:
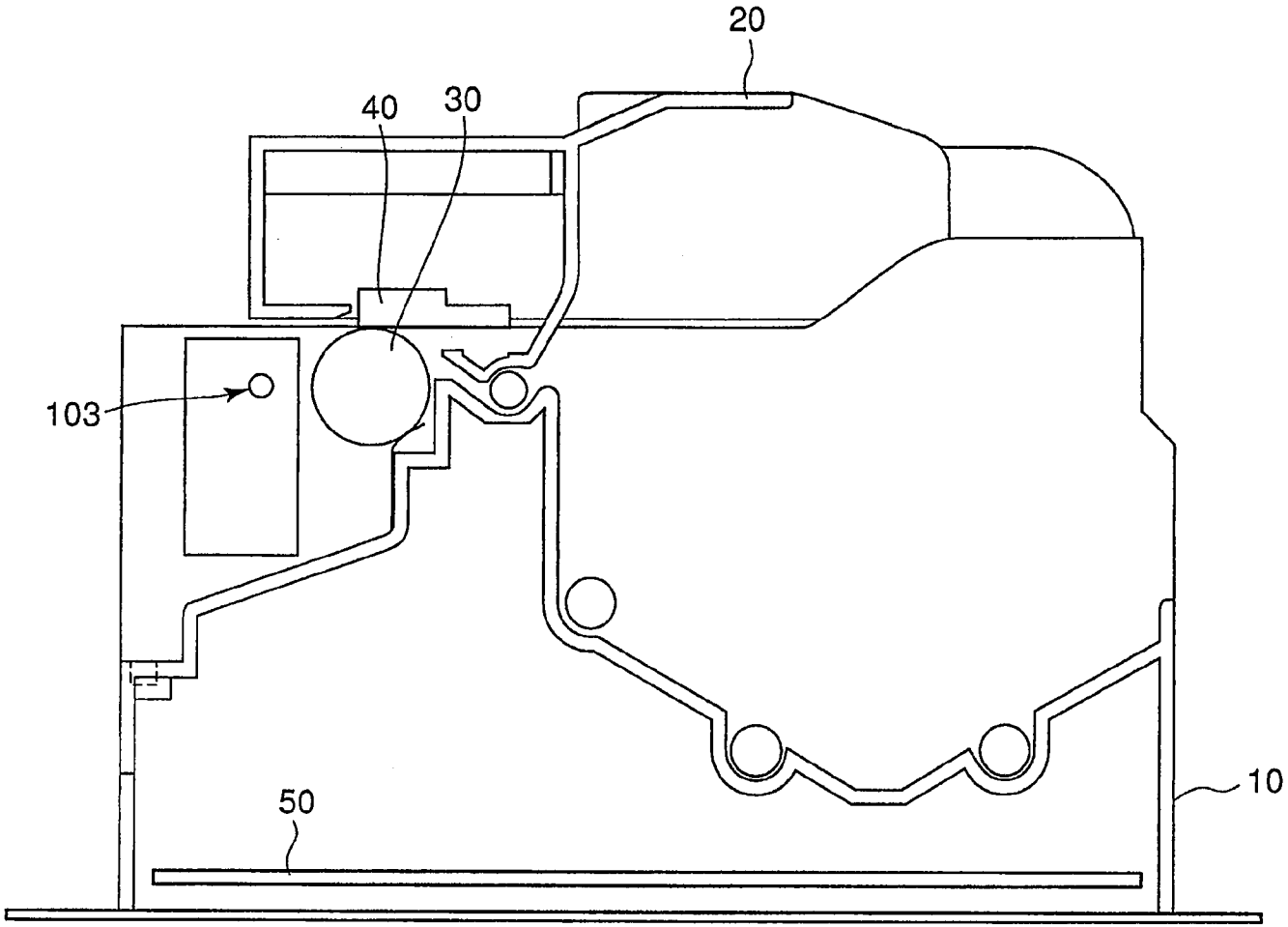
FIG. 1 is a sectional view showing a fundamental structure of a printer as a basis of this invention.

Now, this invention will be described in detail with reference to the drawing.

As an electronic apparatus according to this invention, description will hereinafter be made of a stand-alone printer (independently operable as a printer) associated with a POS (point-of-sale) terminal and used stand-alone and a built-in printer built in a POS terminal. As will readily be understood, however, this invention is also applicable to any printer for use with various apparatuses other than the POS terminal and to various electronic apparatuses other than the printer.

At first referring to FIGS. 1 and 2, description will be made of a printer as a basis of this invention.

Referring to FIG. 1, the printer comprises, as a fundamental structure, a lower frame 10 loaded with a roll paper, an upper frame 20 openably covering the lower frame 10, a platen 30 mounted to the lower frame 10 for feeding out the roll paper, a printing head 40 of, for example, a thermal type for performing printing to a paper surface on a peripheral surface of the platen 30, and a control substrate 50 incorporated into the lower frame 10 for controlling an operation of the printer.

Figure 2:
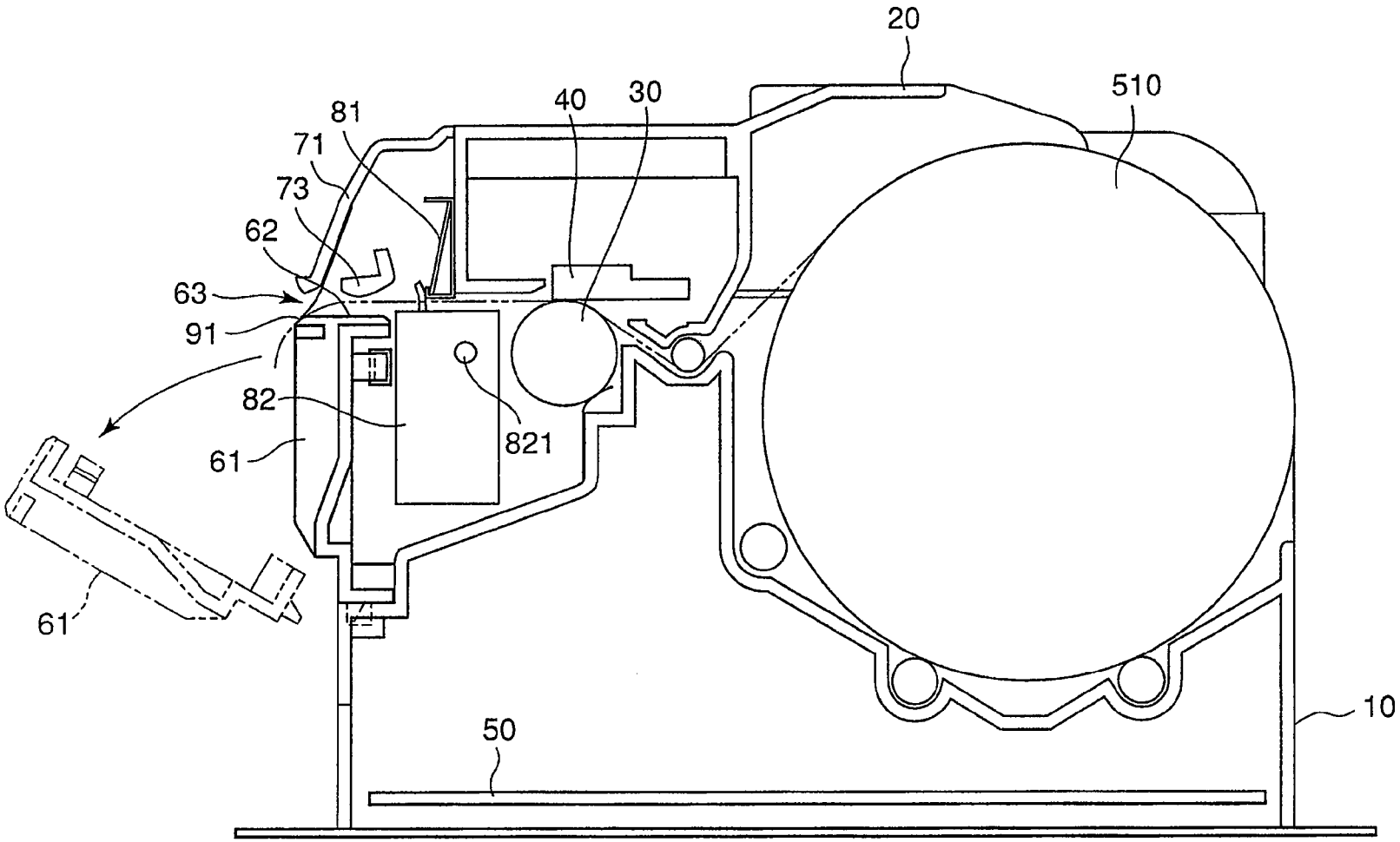
FIG. 2 is a sectional view of a receipt printer (stand-alone printer) which comprises the fundamental structure in FIG. 1 and an additional structure for the receipt printer.

Referring to FIG. 2, a receipt printer (stand-alone printer) comprises an assembly of the fundamental structure in FIG. 1 and an additional structure for the receipt printer. The receipt printer illustrated in the figure is a stand-alone printer. In the figure, a reference numeral 510 represents the roll paper for a receipt.

In FIG. 2, the receipt printer has a cutting structure for cutting the roll paper 510 after printing by the printing head 40. The cutting structure comprises a fixed blade 81 mounted to the upper frame 20 and a movable; cutter unit 82 which is mounted to the lower frame 10 to face the fixed blade 81 with the roll paper 510 interposed therebetween and which is driven by a driving source to cut the roll paper 510.

The movable cutter unit 82 is provided with a cutter reference hole. On the other hand, the lower frame 10 is provided with a frame reference hole 103 (FIG. 1). When the movable cutter unit 82 is mounted to the lower frame 10, a reference shaft 821 is inserted through the cutter reference hole and the frame reference hole 103. Thus, the movable cutter unit 82 is accurately positioned with respect to the lower frame 10. Although not shown in FIG. 2, the movable cutter unit 82 has a gear. When the movable cutter unit 82 is mounted to the lower frame 10, the gear is engaged with a gear (not shown) of the driving source mounted to the lower frame 10. As a consequence, a driving force produced by the driving source is transmitted to the movable cutter unit 82.

The above-mentioned receipt printer has a front cover structure covering front sides of the lower frame 10 and the upper frame 20. The front cover structure comprises a first lower cover 61 adapted to be removably fitted to the lower frame 10 and a first upper cover 71 adapted to be removably fitted to the upper frame 20. The first lower cover 61 has an end portion faced to that of the first upper cover 71. The end portions of the first lower cover 61 and the first upper cover 71 define a first paper ejection port 63 for the receipt printer. The first paper ejection port 63 ejects the roll paper 510 after printing. The first upper cover 71 is provided with a flap 91 attached thereto and closing the first paper ejection port 63 for the purpose of dustproofing and waterproofing. The flap 91 is made of a light-weight flexible material and does not prevent ejection of the roll paper 510.

The above-mentioned receipt printer has a paper ejection structure for guiding the roll paper 510 towards the first paper ejection port 63. The paper ejection structure has a first support path 62 formed on the first lower cover 61 and extending between the movable cutter unit 82 and the end portion (the first paper ejection port 63) of the first lower cover 61. The roll paper 510 passing over the first support path 62 and ejected from the first ejection port 63 is slightly pressed by the flap 91 against the first support path 62 and recovered from deflection or bend to be straightened.

The paper ejection structure for the receipt printer further comprises a jam sensor formed on the first upper cover 71 to face the first support path 62 of the first lower cover 61. The jam sensor serves to detect paper jam in response to rise or protrusion of the roll paper 510 on the first support path 62. The jam sensor comprises an optical sensor (not shown) formed on the first upper cover 71 and, for example, including a light projecting element and a light receiving element, and a paper guide 73 movably attached to the first upper cover 71 so as to be displaced in response to the rise of the roll paper 510 on the first support path 62. When the paper guide 73 is displaced, a detection light beam emitted from the light projecting element towards the light receiving element is shielded or transmitted depending on a position of the paper guide 73. By monitoring the detection light beam, paper jam of the roll paper 510 on the first support path 62 is detected and an operation of the receipt printer is stopped.

In the receipt printer described above, the cutting structure and the front cover structure are individually attached to the lower frame 10 and the upper frame 20. However, this invention is not limited thereto. For example, the front cover structure, the cutting structure, and the paper ejection structure may be formed into a single integral unit. Specifically, the fixed blade 81 may be mounted to the first upper cover 71 and, through the first upper cover 71, mounted to the upper frame 20 while the movable cutter unit 82 may be mounted to the first lower cover 61 and, through the first lower cover 61, mounted to the lower frame 10.

Next referring to FIGS. 3 to 8, description will be made of a printer according to one embodiment of this invention.

In order to cope with a change in design between a printer (stand-alone printer) having a hip down design specification (first specification) in FIGS. 3 to 5C and another printer (built-in printer built in a POS terminal) having a hip up design specification (second specification) in FIGS. 6 to 8C, each of the lower frame 10 and the upper frame 20 has a structure common to both of the specifications. The lower frame 10 and the upper frame 20 are coupled to each other by a hinge structure removably attached to the lower frame 10 and the upper frame 20. The hinge structure is selected from a first hinge structure illustrated in FIGS. 5A-5C and a second hinge structure illustrated in 8A-8C. By changing the hinge structure from the first hinge structure to the second hinge structure and vice versa, the height of a hinge center can easily be changed.

Figure 3:
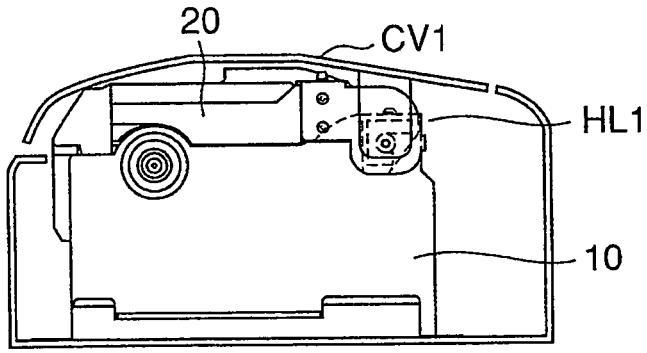
FIG. 3 is a view for describing a printer (stand-alone printer) of a hip down design specification (first specification) according to one embodiment of this invention in a state where an upper frame is closed.
Figure 4:
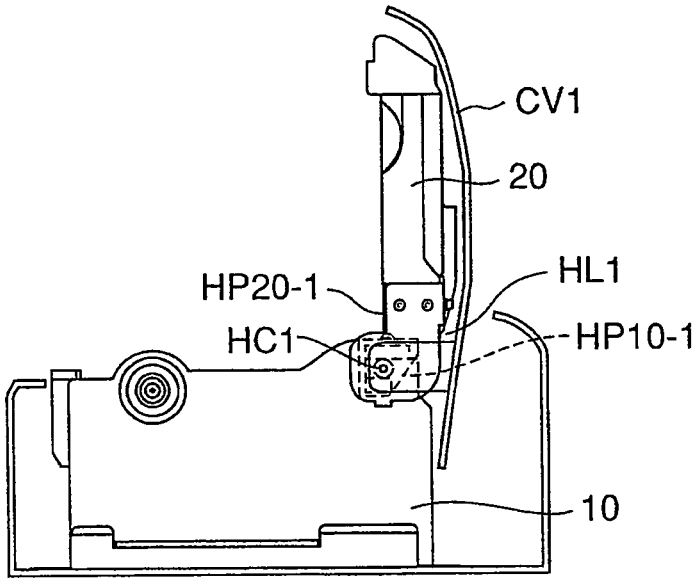
FIG. 4 is a view showing the printer in FIG. 3 in a state where the upper frame is opened.

FIG. 3 shows a printer (stand-alone printer) of a hip down design specification (first specification) in a state where an upper frame is closed. FIG. 4 shows the printer in FIG. 3 in a state where the upper frame is opened. FIGS. 5A, 5B, and 5C show a pair of hinge portions used in the printer in FIG. 3.

FIG. 6 shows a printer (built-in printer built in a POS terminal) of a hip up design specification (second specification) in a state where an upper frame is closed. FIG. 7 shows the printer in FIG. 6 in a state where the upper frame is opened. FIGS. 8A, 8B, and 8C show a pair of hinge portions used in the printer in FIG. 6.

In FIGS. 3 and 4, the printer according to the one embodiment of this invention is constructed as a printer (stand-alone printer) having a hip down design specification (first specification). In FIGS. 6 and 7, the printer according to the one embodiment of this invention is constructed as a printer (built-in printer built in a POS terminal) having a hip up design specification (second specification). In either event, the printers in FIGS. 3 and 4 and in FIGS. 6 and 7 are same in fundamental structure to the printer (stand-alone printer) described with reference to FIGS. 1 and 2. Specifically, each of the printers in FIGS. 3 and 4 and in FIGS. 6 and 7 is a printer which comprises the lower frame 10 loaded with the roll paper and the upper frame 20 covering the lower frame 10 and which performs printing onto a paper surface while the roll paper is fed out.

The printer according to the one embodiment of this invention is different from the printer (stand-alone printer) described with reference to FIGS. 1 and 2 in the following respects. In the printer according to the one embodiment of this invention, a pair of hinge structures allowing the upper frame 20 to openably cover the lower frame 10 are removably attached to the lower frame 10 and the upper frame 20, as shown in FIGS. 5A to 5C and 8A to 8C. As the pair of hinge structures, a pair of first-specification hinge structures HL1 and HR1 (FIGS. 5A to 5C) or a pair of second-specification hinge structures HL2 and HR2 (FIGS. 8A to 8C) are selectively used.

Referring to FIGS. 3 to 5C, each of the first-specification hinge structures HL1 and HR1 (FIGS. 5A-5C) comprises a first lower frame hinge piece HP10-1 and a first upper frame hinge piece HP20-1. The first lower frame hinge piece HP10-1 has a first hinge center HC1 at its center and is removably attached to the lower frame 10 so that the first hinge center HC1 is positioned on an upper surface of the lower frame 10. The first upper frame hinge piece HP20-1 has a first hinge center HC1 at its one end and has the other end removably attached to the upper frame 20.

Referring to FIGS. 6 to 8C, each of the second-specification hinge structures HL2 and HR2 (FIGS. 8A-8C) comprises a second lower frame hinge piece HP10-2 and a second upper-frame hinge piece HP20-2. The second lower frame hinge piece HP10-2 has a second hinge center HC2 at its one end and has the other end removably attached to the lower frame 10 so that the second hinge center HC2 is positioned above the upper surface of the lower frame 10. The second upper frame hinge piece HP20-2 has a second hinge center HC2 at its one end and has the other end removably attached to the upper frame 20.

Particularly, in FIGS. 3 to 5C, the first lower frame hinge piece HP10-1 of each of the first-specification hinge structures HL1 and HR1 (FIGS. 5A-5C) is removably attached to the lower frame 10 so that the first hinge center HC1 is positioned on the upper surface of a rear part of the lower frame 10.

In this case, in FIGS. 6 to 8C, the second lower frame hinge piece HP10-2 of each of the second-specification hinge structures HL2 and HR2 (FIGS. 8A to 8C) is removably attached at its other end to the lower frame 10 so that the second hinge center HC2 is positioned rearward from the rear part of the lower frame 10 and above the upper surface of the lower frame 10.

Herein, the distance between the one end and the other end of the second upper frame hinge piece HP10-2 of each of the second-specification hinge structures HL2 and HR2 (FIGS. 8A to 8C) in FIGS. 6 to 8C is greater than the distance between the one end and the other end of the first upper frame hinge piece HP10-1 of each of the first-specification hinge structures HL1 and HR1 (FIGS. 5A to 5C).

The printer according to the one embodiment of this invention further has a cover structure covering an upper side of the upper frame 20. As the cover structure, a first-specification cover structure CV1 (FIGS. 3 and 4) or a second-specification cover structure CV2 (FIGS. 6 and 7) is selectively used.

The first-specification cover structure CV1 (FIGS. 3 and 4) has a first-specification cover main body. The first-specification cover main body is rotatably attached to the first hinge centers HC1 of the first-specification hinge structures HL1 and HR1 (FIGS. 5A-5C) and openably covers the upper side of the upper frame 20 and upper sides of the first-specification hinge structures HL1 and HR1 (FIGS. 5A to 5C).

On the other hand, the second-specification cover structure CV2 (FIGS. 6 and 7) has a second-specification cover main body. The second-specification cover main body is rotatably attached to the second hinge centers HC2 of the second-specification hinge structures HL2 and HR2 (FIGS. 8A to 8C) and openably covers the upper side of the upper frame 20 and upper sides of the second-specification hinge structures HL2 and HR2 (FIGS. 8A to 8C).

Since the first specification is the hip down design specification while the second specification is the hip up design specification, the height of the second-specification cover structure CV2 (FIGS. 6 and 7) is higher than that of the first-specification cover structure CV1 (FIGS. 3 and 4).

With the first-specification cover structure CV1 (FIGS. 3 and 4) and the second-specification cover structure CV2 (FIGS. 6 and 7) described above, the cover main body can be opened by the use of the hinge centers of the printer.

Although this invention has been described in conjunction with the exemplary embodiment, this invention is not limited to the foregoing embodiment. For example, this invention is also applicable to a ticket printer used in a ticket or coupon issuing machine to print a ticket or a coupon. The ticket printer is also a printer which comprises a lower frame loaded with a roll paper and an upper frame covering the lower frame and which performs printing on a paper surface while a roll paper is fed out.

What is claimed is:

1. A system comprising:

an electronic apparatus comprising a lower frame, an upper frame, and a selected one of hinge structures, the hinge structures allowing the upper frame to openably cover the lower frame, wherein:

the hinge structures are removably attached to the lower frame and the upper frame and include a first-specification hinge structure and a second-specification hinge structure;

said system comprising, as the selected one of the hinge structures, the first-specification hinge structure when said apparatus is constructed as the electronic apparatus of a hip down design specification;

the first-specification hinge structure comprising:

a first lower frame hinge piece having a first hinge center at its center and removably attached to the lower frame so that the first hinge center is positioned on an upper surface of the lower frame; and a first upper frame hinge piece having the first hinge center at its one end and having the other end removably attached to the upper frame;

said system comprising, as the selected one of the hinge structures, the second-specification hinge structure when said system is constructed as the electronic apparatus of a hip up design specification;

the second-specification hinge structure comprising:

a second lower frame hinge piece having a second hinge center at its one end and having the other end removably attached to the lower frame so that the second hinge center is positioned above the upper surface of the lower frame; and a second upper frame hinge piece having the second hinge center at its one end and having the other end removably attached to the upper frame.

2. The system according to claim 1, wherein:

the first lower frame hinge piece of the first-specification hinge structure is removably attached to the lower frame so that the first hinge center is positioned on the upper surface of a rear part of the lower frame;

the second lower frame hinge piece of the second-specification hinge structure being removably attached at its other end to the lower frame so that the second hinge center is positioned rearward from the rear part of the lower frame and above the upper surface of the lower frame.

3. The system according to claim 2, wherein:

the distance between the one end and the other end of the second upper frame hinge piece of the second-specification hinge structure is greater than the distance between the one end and the other end of the first upper frame hinge piece of the first-specification hinge structure.

4. The system according to claim 1, wherein the electronic apparatus further comprises a cover structure which covers an upper side of the upper frame and which is selected from a first-specification cover structure and a second-specification cover structure;

the first-specification cover structure comprising:

a first-specification cover main body rotatably attached to the first hinge center of the first-specification hinge structure and openably covering the upper side of the upper frame and an upper side of the first-specification hinge structure;

the second-specification cover structure comprising:

a second-specification cover main body rotatably attached to the second hinge center of the second-specification hinge structure and openably covering the upper side of the upper frame and an upper side of the second-specification hinge structure.

5. The system according to claim 1, wherein:

the electronic apparatus is a printer which comprises the lower frame loaded with a roll paper and the upper frame covering the lower frame and which performs printing to a paper surface while the roll paper is fed out.

6. A system comprising:

an electronic apparatus comprising a lower frame, an upper frame, and a selected pair of hinge structures selected from a pair of first-specification hinge structures and a pair of second-specification hinge structures, the first-specification hinge structures and the second-specification hinge structures allowing the upper frame to openably cover the lower frame, wherein:

the first-specification hinge structures and the second-specification hinge structures are removably attached to the lower frame and the upper frame;

said system comprising, as the selected pair hinge structures, the first-specification hinge structures when said system is constructed as the electronic apparatus of a hip down design specification;

each of the first-specification hinge structures comprising:

a first lower frame hinge piece having a first hinge center at its center and removably attached to the lower frame so that the first hinge center is positioned on an upper surface of the lower frame;

a first upper frame hinge piece having the first hinge center at its one end and having the other end removably attached to the upper frame;

said system comprising, as the selected pair of hinge structures, the second-specification hinge structures when said system is constructed as the electronic apparatus of a hip up design specification;

each of the second-specification hinge structures comprising:

a second lower frame hinge piece having a second hinge center at its one end and having the other end removably attached to the lower frame so that the second hinge center is positioned above the upper surface of the lower frame; and a second upper frame hinge piece having the second hinge center at its one end and having the other end removably attached to the upper frame.

7. The system according to claim 6, wherein:

the first lower frame hinge piece of each of the first-specification hinge structures is removably attached to the lower frame so that the first hinge center is positioned on the upper surface of a rear part of the lower frame;

the second lower frame hinge piece of each of the second-specification hinge structures is removably attached at its other end to the lower frame so that the second hinge center is positioned rearward from the rear part of the lower frame and above the upper surface of the lower frame.

8. The system according to claim 7, wherein:

the distance between the one end and the other end of the second upper frame hinge piece of each of the second-specification hinge structures is greater than the distance between the one end and the other end of the first upper frame hinge piece of each of the first-specification hinge structures.

9. The system according to claim 6, wherein the electronic apparatus further comprising a cover structure which covers an upper side of the upper frame and which is selected from a first-specification cover structure and a second-specification cover structure;

the first-specification cover structure comprising:

a first-specification cover main body rotatably attached to the first hinge centers of the first-specification hinge structures and openably covering the upper side of the upper frame and upper sides of the first-specification hinge structures;

the second-specification cover structure comprising:

a second-specification cover main body rotatably attached to the second hinge centers of the second-specification hinge structures and openably covering the upper side of the upper frame and upper sides of the second-specification hinge structures.

10. The system according to claim 6, wherein:

the electronic apparatus is a printer which comprises the lower frame loaded with a roll paper and the upper frame covering the lower frame and which performs printing to a paper surface while the roll paper is fed out.

* * * * *